US006550388B2

(12) United States Patent
McIlwraith

(10) Patent No.: US 6,550,388 B2
(45) Date of Patent: Apr. 22, 2003

(54) APPARATUS AND METHOD FOR REMOVING A THIN DEFORMABLE SHEET

(75) Inventor: Lon McIlwraith, Delta (CA)

(73) Assignee: Creo Products Inc., Burnaby (CA)

( * ) Notice: Subject to any disclaimer, the term of this patent is extended or adjusted under 35 U.S.C. 154(b) by 0 days.

(21) Appl. No.: 09/729,786

(22) Filed: Dec. 6, 2000

(65) Prior Publication Data

US 2002/0066385 A1 Jun. 6, 2002

(51) Int. Cl.[7] ..... B41L 47/14; B65H 5/00; B65H 3/30; B65H 3/40; B65H 7/08

(52) U.S. Cl. ..... 101/477; 271/5; 271/19; 271/20; 271/21; 271/91; 271/106; 271/4; 271/11; 271/112

(58) Field of Search ..... 101/479, 477, 101/415.2; 271/5, 19, 20, 21, 91, 106, 4, 11, 112

(56) References Cited

U.S. PATENT DOCUMENTS

| | | | | |
|---|---|---|---|---|
| 3,041,067 A | | 6/1962 | Fux et al. | |
| 3,568,594 A | * | 3/1971 | Johnston | 101/152 |
| 3,586,316 A | | 6/1971 | Ehlscheid et al. | |
| 3,806,114 A | | 4/1974 | Carter | |
| 4,052,050 A | | 10/1977 | Carter | |
| 4,667,948 A | | 5/1987 | Angelbeck et al. | |
| 4,822,022 A | | 4/1989 | Attenasio | |
| 4,878,799 A | | 11/1989 | Seto et al. | |
| 5,441,249 A | * | 8/1995 | Todaro et al. | 271/107 |
| 5,622,111 A | * | 4/1997 | Bachmeir et al. | 101/415.1 |
| 5,711,222 A | * | 1/1998 | Taylor et al. | 101/383 |
| 5,992,324 A | | 11/1999 | Rombult et al. | |
| 6,000,337 A | | 12/1999 | Blake et al. | |
| 6,308,620 B1 | * | 10/2001 | Wadlinger et al. | 101/183 |

FOREIGN PATENT DOCUMENTS

| | | |
|---|---|---|
| DE | 4038544 | 6/1992 |
| DE | 4105269 | 9/1992 |

OTHER PUBLICATIONS

Seybold Report on Publishing Systems vol.24,No. 20 (Jun. 26, 1995).
Barco Lithosetter Brochure, (May 1995).
Adams et al., Computer–to–Plate: Automating the Printing Industry pp. 143—150 (1996).
Llmburg, Essentials of Computer–to–Plate Technology, pp. 48–49 (1995).
ICG Titan 582 Brochure, May 1995.
Adams et al.,Computer–to–Plate: Automating the Printing Industry pp. 159–170 (1996).
Adams et al., Computer–to–Plate : Automating the Printing Industry pp. 177—182 (1996).
Adams et al., Computer–to–Plate: Automating the Printing Industry pp. 135–143 (1996).

* cited by examiner

*Primary Examiner*—Andrew H. Hirshfeld
*Assistant Examiner*—Marvin P. Crenshaw
(74) *Attorney, Agent, or Firm*—Oyen Wiggs Green & Mutala

(57) ABSTRACT

An apparatus for removing slip sheets from printing plates has two concentric cylinders that are mutually rotatable about a common axis. Suction exerted via two elongated slots separates a deformable sheet from a relatively rigid object to which it is adhered. The deformable sheet is drawn into a recess presented by the two aligned slots. The concentric cylinders are then rotated to grip the deformable sheet between opposing edges of the slots.

31 Claims, 2 Drawing Sheets

APPARATUS AND METHOD FOR REMOVING A THIN DEFORMABLE SHEET

FIELD OF THE INVENTION

The invention pertains to the field of printing and in particular to the field of automated loading of printing plates.

BACKGROUND OF THE INVENTION

In the commercial printing industry, an important step in the preparation of images for printing is the transfer of image information to a substrate that can then be used repeatedly to print the image. While the substrate can take a variety of forms, one of the most extensively used forms is the printing plate, a flat sheet of material with a surface that can be modified in order to selectively retain or repel ink. In general, the modifiable surface is the result of a special coating, commonly referred to as an emulsion, which is a radiation-sensitive coating that changes its properties when exposed to radiation such as visible, ultraviolet, or infrared light. The emulsion coating sits on the surface of a base sheet, which itself may be composed of a variety of materials such as aluminum, polyester, or rubber.

The transfer of image information to a printing plate can be done in a variety of ways. A long-established method is to transfer the image first to a photographic film, and then use the photographic film in order to selectively expose parts of the printing plate to radiation (e.g., visible light), thereby transferring image information to the plate. With the increasing use of information technologies in the graphic arts industry, however, this film-based method is less than efficient for printing images that are stored as computer files. A more recent approach, commonly known as CTP or Computer to Plate, takes advantage of the efficiencies inherent in computerization by transferring the image information directly to the printing plate, eliminating the intermediate step of transferring the image to a photographic film.

The advent of CTP technology is part of an increasing trend towards automation in the printing industry. The increasing use of information technology to create and distribute electronic and print publications, coupled with the more widespread accessibility of such technologies, is contributing to a greater demand for shorter print runs and faster turnaround times. These changes, in turn, have contributed to a greater push toward automating all aspects of the printing process.

Automating the printing industry presents unique technological hurdles. In the case of printing plates, some of these hurdles result from the delicacy of the unexposed emulsion-coated surfaces of these plates. These emulsion-coated surfaces are easily marred, and if marred, create undesirable defects in the final printed product. Attempts to automate the handling of printing plates require measures to prevent damage to the emulsion-coated surfaces of the unexposed plates.

Measures used to reduce marring of plates during storage or transport, however, introduce additional problems for automation. Unexposed plates are typically supplied in packages of 25 to 100 with interleaf sheets, more commonly referred to as "slip sheets", between the plates. These slip sheets, which may be made of a variety of materials, are used to protect the sensitive printing surfaces of the plates by providing a physical barrier between the emulsion on one plate and the adjacent plate. The slip sheets must be removed from the printing plates prior to imaging.

The need to move sheets of various materials by automated means is not a new problem, and various satisfactory methods for handling sheets have been developed for a number of contexts and industries. The garment industry, for example, uses various combinations of mechanical arid vacuum techniques to pick sheets of textile from the top or bottom of stacks. Office equipment such as photocopiers and printers also employ various means to move individual sheets of paper from a larger stack of paper. Such techniques typically employ friction between rollers and paper surfaces to engage and transport sheets. Within the printing industry, commercial printing presses have long employed similar methods to rapidly feed sheets of paper into sheet-fed printing presses. A long established solution for the feeding of paper into printing presses involves using flexible suction (vacuum) cups in association with other devices to pick up individual paper sheets.

However, the automation of slip sheet removal for the printing industry presents a number of unique problems. In contrast to the examples described above, slip sheet removal is not simply a matter of moving a single sheet from a stack of similar sheets. In general, slip sheets are made of materials different from those used for printing plates, and are further differentiated by being substantially thinner, lighter, and less rigid than the plates they separate. These characteristics also make slip sheets more deformable than their neighboring printing plates. Removing a thin, lightweight, and relatively deformable slip sheet sandwiched between relatively heavy printing plates is a technological challenge further complicated by the fact that the slip sheets must be removed without damaging the sensitive surfaces of the printing plates. The removal process can also be complicated by the fact that slip sheets and plates are often quite large. At present, very large format printing plates can be as large as 58 inches by 80 inches, with correspondingly large sizes for the intervening slip sheets. In addition, the actual materials used for slip sheets can vary, although commonly the slip sheet material is paper, which may be fragile and easily torn.

Another difficulty is that slip sheets tend to adhere to printing plate surfaces when plates are separated from each other. As a result, the exact position of the slip sheet relative to a plate is not consistent. A slip sheet can adhere to the top emulsion-coated surface of a printing plate as it is moved away from its neighboring plate; it may also adhere to the bottom (i.e. non-emulsion-coated) surface of a plate. The tendency of the slip sheets to adhere also complicates slip sheet removal, especially since the slip sheets must be separated from printing plates without scratching or otherwise damaging the emulsion-coated surfaces of the plates. Since the emulsions are very delicate, any mechanical impact imposed upon the emulsion-coated surface of the plate is a potential source of damage, even if it occurs through a slip sheet.

A possible means of addressing this problem is to use suction cups to remove the slip sheets. The use of a vacuum is particularly attractive as it has the potential to eliminate unwanted contact with the sensitive surfaces of the printing plates. A vacuum can be used to draw slip sheets into a desired position from one side without requiring mechanical contact to move the slip sheet. Suction cups have been successfully used in other contexts, for example, to move paper in sheet-fed presses.

However, attempts to remove slip sheets using suction cups tend to fail for a number of reasons:

1. Slip sheets often are so porous that a suction cup cannot achieve sufficient vacuum suction to lift the slip sheet;
2. The slip sheet porosity can lead to a suction cup gripping the non-porous printing plate below, through the slip sheet, and lifting both together;

3. Slip sheets can be very large in some application, such that a slip sheet may be lifted by a suction cup, but the suction cup may not be capable of moving the slip sheet laterally without releasing it;
4. Flexible suction cups have very little peripheral stiffness on their own and rely on the stiffness of the object being picked up to maintain a good seal around the edge of the cup, and to prevent the cup from collapsing on itself. Slip sheets rarely provide sufficient stiffness to permit reliable gripping and are prone to wrinkling at the interface between suction cup and slip sheet, causing vacuum failure and premature release.

There is a need for a method and apparatus for reliably removing slip sheets without causing unnecessary damage to the printing plate surfaces protected by the slip sheets.

BRIEF SUMMARY OF THE INVENTION

In accordance with the present invention, two concentric cylinders, that are mutually rotatable about their common axis, employ suction exerted through two commonly aligned slots in their cylindrical surfaces to separate a deformable sheet from either surface of a flat sheet to which it is adhered. The deformable sheet is then drawn into the recess presented by the two commonly aligned slots. These two concentric cylinders are then rotated su.ch that the deformable sheet is gripped between opposing edges of the two slots. Having gripped the deformable sheet, the removal of the deformable sheet is completed by moving the concentric cylinders over a distance.

DETAILED DESCRIPTION OF THE PREFERRED EMBODIMENT

Figure 1:
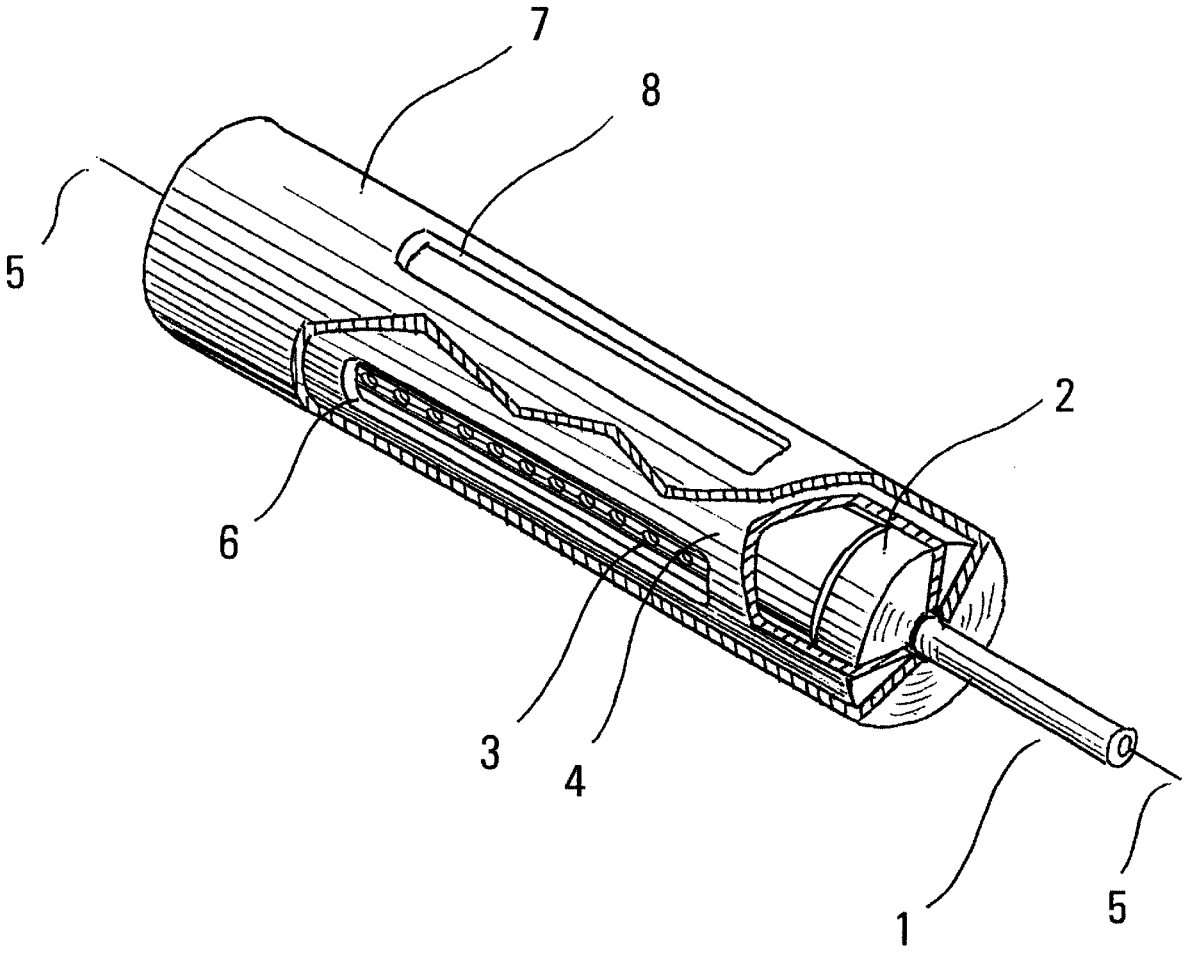
FIG. 1 depicts an apparatus for slip sheet manipulation according to one embodiment of the invention.

FIG. 1 illustrates an apparatus according to one embodiment of the invention. A vacuum line 1 provides suction from inside a bore of a hollow, fixed cylinder 2, which comprises a cylindrical surface into which vacuum supply apertures 3 have been fashioned. A close-fitting cylinder 4 fits concentrically around fixed cylinder 2 and may be rotated about the common axis 5 of cylinders 2 and 4. Close-fitting cylinder 4 has an axial slot 6 in its cylindrical surface, which functions as a vacuum orifice. Cylinder 2 may act as a bearing axle about which cylinder 4 may rotate. A third concentric and close-fitting cylinder 7 is arranged concentrically with cylinders 2 and 4. Third concentric cylinder 7 is also rotatable about common axial rotation axis 5 and comprises a slot 8 on its cylindrical surface. Slot S also acts as an orifice through which suction may be exerted when brought into alignment with apertures 3 and slot 6.

Figure 2A:
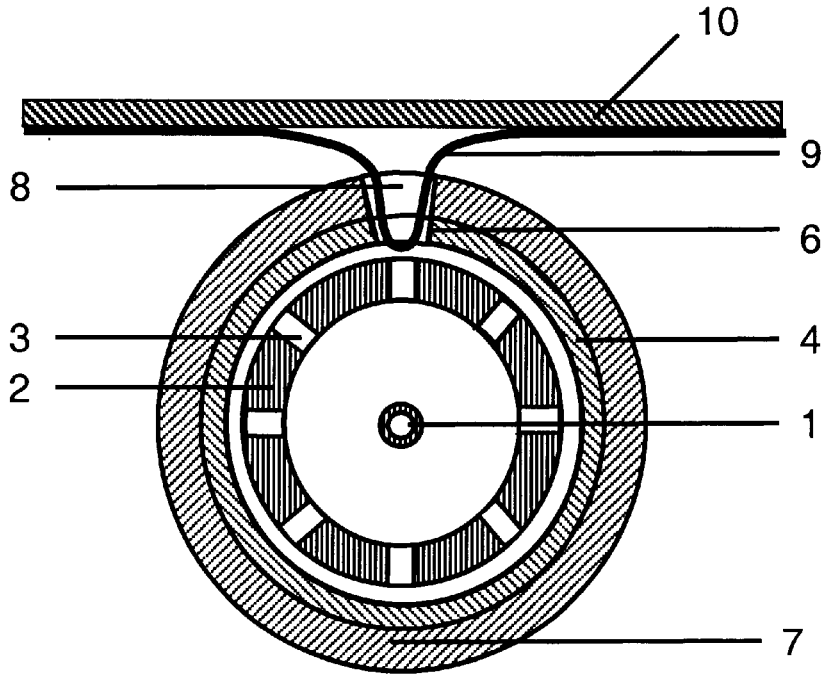
FIG. 2A depicts a cross-sectional view of the apparatus of FIG. 1 performing a method of slip sheet manipulation at a first point in time.

In FIG. 2A, the apparatus of FIG. 1 is depicted implementing a method of slip sheet manipulation in accordance with one embodiment of the invention. The apparatus is brought into the close proximity of thin deformable sheet 9, which is adhered to the bottom of flat sheet 10. Thin deformable sheet 9 may be a slip sheet and flat sheet 10 may be a printing plate. The mechanical apparatus or servo-mechanical devices that control and execute the motion of the apparatus into close proximity of thin deformable sheet 9 and the motion of rotatable cylinders 4 and 7 are not shown. Such apparatus are well known to those skilled in the art. Cylinder 4 and cylinder 7 are rotated, both with respect to cylinder 2 and with respect to each other, about their common axis 5 until slots 6 and 8 are mutually aligned in an orientation that is proximate to thin deformable sheet 9. The suction produced by vacuum line 1 through apertures 3 and aligned slots 6 and 8 begins to draw thin a bight of deformable sheet 9 into the aligned orifices 6 and 8 as shown in FIG 2A.

Figure 2B:
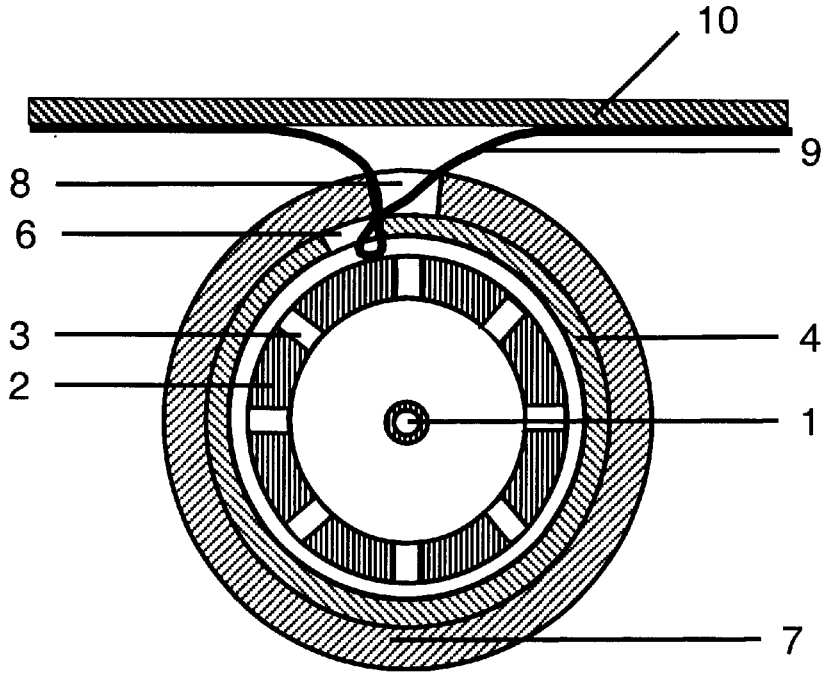
FIG. 2B depicts a cross-sectional view of the apparatus of FIG. 1 performing the method of slip sheet manipulation at a later point in time.

After the bight of thin deformable sheet 9 is drawn into aligned slots 6 and 8, the two cylinders 4 and 7 are rotated with respect to each other and thin deformable sheet 9 is mechanically gripped between the opposing edges of slots 6 and 8. This gripping process is depicted in FIG. 2B.

It is evident that the apparatus depicted in FIG. 1 may, by the same technique as described above, be placed proximate to a thin deformable sheet 9, which is adhered to the top surface of flat sheet 10 (not shown). The two cylinders 4 and 7 are rotated, such that slots 6 and 8 are once again aligned, but, in this case, the alignment of slots 6 and 8 is directed towards thin deformable sheet 9 on the top surface of flat sheet 10. Thin deformable sheet 9 may be drawn into aligned slots 6 and 8 and gripped by the rotation of cylinders 4 and 7 in the same fashion as described above.

The method therefore represents a means of removing thin deformable sheet 9 from either surface of flat sheet 10 without mechanically touching flat sheet 10. Having securely gripped thin deformable sheet 9 on either surface of flat sheet 10, thin deformable sheet 9 may be removed entirely by mechanically withdrawing the entire apparatus of FIG. 1 over an appropriate distance dictated by the physical extent of sheet 10. Suction may be left on or turned off after thin deformable sheet 9 has been gripped mechanically by the two cylinders 4 and 7. The circular cross-section of cylinder 7 and the axial orientation of slots 6 and 8 on the cylindrical surfaces of cylinders 4 and 7 create a rigid-edge geometry that reliably picks up thin deformable sheets, but will not pick up rigid objects.

By the above method, it is possible to implement the removal of slip sheets from either side of a mechanically sensitive printing plate. In the case of printing plates and slip sheets, the rigid edge geometry allows the reliable removal of non-rigid slip sheets, but ensures that the rigid and scratch-sensitive printing plates will not be picked up or touched.

While the cylindrical geometry depicted in the preferred embodiment is simple to implement, there are clearly other geometries that will also achieve the same aim.

In an alternative embodiment, the vacuum may be applied via a different route to the inner of the two orifices.

In yet another embodiment, the two outer cylinders are replaced with more generalized mechanical shapes containing orifices that may be aligned.

In yet another embodiment, the outer cylinders or mechanical shapes with mutually alignable orifices rotate about a common rotation axis, but as a combination they are rotated or swiveled about a separate axis or point that does not coincide with their common rotation axis.

In yet another embodiment the two cylinders are replaced by flat structures, each with an alignable orifice, that are slid with respect to each other to align slots, with the inner of the two flat structures having vacuum supplied to its orifice.

What is claimed is:

1. A method for separating a deformable sheet from a relatively rigid object, the method comprising:

creating a pressure differential and thereby drawing a portion of the deformable sheet away from the object and into a space between a first edge of a first member and a second edge of a second member; and moving the first and second edges relative to one another to grip the portion of the deformable sheet between the first and second edges.

2. A method according to claim 1, wherein creating a pressure differential comprises applying suction in a region between the first and second edges.

3. A method according to claim 1, comprising, after moving the first and second edges relative to one another to grip the portion of the deformable sheet, moving the first and second members together relative to the object to completely separate the deformable sheet from the object.

4. A method according to claim 1, wherein the deformable sheet is a slip sheet, the relatively rigid object comprises a substantially flat printing plate and the slip sheet is adhered to a surface of the printing plate.

5. A method according to claim 1, wherein the deformable sheet is a slip sheet, the relatively rigid object is a substantially flat photographic plate and the slip sheet is adhered to a surface of the photographic plate.

6. A method for separating a deformable sheet from a relatively rigid object, the method comprising:

creating a pressure differential and thereby drawing a portion of the deformable sheet away from the object and into a space between a first edge of a first member and a second edge of a second member; and moving the first and second edges relative to one another to grip the portion of the deformable sheet between the first and second edges, wherein the first edge is an edge of a first aperture in the first member and the second edge is an edge of a second aperture in the second member and wherein moving the first and second edges relative to one another comprises moving the first and second apertures from a first configuration wherein the first and second apertures are at least partially aligned to a second configuration wherein the deformable sheet is gripped between the first and second edges.

7. A method according to claim 6, wherein moving the first and second apertures comprises rotating at least one of the first and second members.

8. A method according to claim 7, wherein moving the first and second apertures comprises rotating at least one of the first and second members about a common axis common to the first and second members.

9. A method according to claim 8, wherein moving the first and second apertures comprises rotating the first and second members in opposite angular directions about the common axis.

10. A method according to one of claims 7, 8 or 9, wherein the first and second apertures comprise elongated slots and drawing the portion of the deformable sheet away from the object comprises drawing an elongated portion of the deformable sheet into the slots.

11. A method for separating a deformable sheet from a relatively rigid object, the method comprising:

creating a pressure differential and thereby drawing a portion of the deformable sheet away from the object and into a space between a first edge of a first member and a second edge of a second member; and moving the first and second edges relative to one another to grip the portion of the deformable sheet between the first and second edges, wherein drawing a portion of the deformable sheet away from the object comprises drawing a bight of the deformable sheet away from the object and into the space between the first edge of the first member and the second edge of the second member.

12. A method for separating a deformable sheet from a relatively rigid object, the method comprising:

drawing a portion of the deformable sheet away from the object and into a recess formed by a first aperture in a first member that is in at least partial alignment with a second aperture in a second member; and, gripping the portion of the deformable sheet between an edge of the first aperture and an edge of the second aperture by moving the first and second members relative to one another.

13. An apparatus for separating a deformable sheet from a surface of a relatively rigid object, the apparatus comprising:

first and second members movable relative to one another between a first configuration wherein the first and second members form a recess capable of receiving a portion of a deformable sheet and a second configuration wherein the first and second members are capable of gripping a deformable sheet; and, a source of suction located in the recess, the source of suction positioned to draw a portion of a deformable sheet located in a vicinity of the recess into the recess and away from the object.

14. An apparatus according to claim 13, wherein the first and second members are slidably mounted to one another.

15. An apparatus for separating a deformable sheet from a surface of a relatively rigid object, the apparatus comprising;

first and second members movable relative to one another between a first configuration wherein the first and second members form a recess capable of receiving a portion of a deformable sheet and a second configuration wherein the first and second members are capable of gripping a deformable sheet; and, a source of suction located in the recess, the source of suction positioned to draw a portion of a deformable sheet located in a vicinity of the recess into the recess and away from the object, wherein the first member is penetrated by a first aperture, the second member is penetrated by a second aperture and the recess is formed by an at least partial alignment of the first and second apertures.

16. An apparatus according to claim 15, wherein at least one of the first and second apertures comprises an elongated slot.

17. An apparatus for separating a deformable sheet from a surface of a relatively rigid object, the apparatus comprising:

first and second members movable relative to one another between a first configuration wherein the first and second members form a recess capable of receiving a portion of a deformable sheet and a second configuration wherein the first and second members are capable of gripping a deformable sheet; and, a source of suction located in the recess, the source of suction positioned to draw a portion of a deformable sheet located in a vicinity of the recess into the recess and away from the object, wherein the first member comprises a substantially hollow member and the second member comprises a second cylinder located in a bore of the first member.

18. An apparatus according to claim 17, wherein the first member comprises a first cylinder and the first and second cylinders are concentric about a common axis.

19. An apparatus according to claim 17 comprising means for rotating the first member and the second cylinder relative to one another.

20. An apparatus according to claim 17, wherein a wall of the first member comprises a first aperture and the recess is formed by an at least partial alignment of the first aperture with a feature of the second cylinder.

21. An apparatus according to claim 20, wherein the feature of the second cylinder comprises a second aperture in communication with the source of suction.

22. An apparatus according to claim 20, wherein the first aperture comprises a first slot that is elongated in one direction.

23. An apparatus according to claim 22, wherein the second aperture comprises a second slot in a cylindrical surface of the second cylinder, and the first and second slots are elongated in a direction parallel to a cylindrical axis of the second cylinder.

24. An apparatus according to claim 17, wherein the source of suction is located in a bore of the second cylinder.

25. An apparatus for separating a deformable sheet from a surface of a relatively rigid object, the apparatus comprising:

first and second members slidably mounted to one another and movable relative to one another between a first configuration wherein the first and second members form a recess capable of receiving a portion of a deformable sheet and a second configuration wherein the first and second members are capable of gripping a deformable sheet; and, a source of suction located in the recess, the source of suction positioned to draw a portion of a deformable sheet located in a vicinity of the recess into the recess and away from the object, wherein the first member comprises a first aperture therethrough, the second member comprises a second aperture therethrough and the recess is formed by an at least partial alignment of the first and second apertures.

26. An apparatus according to claim 25, wherein at least one of the first and second apertures comprises an elongated slot.

27. An apparatus for separating a deformable sheet from a surface of a relatively rigid object, the apparatus comprising:

first and second members movable relative to one another between a first configuration wherein the first and second members form a recess capable of receiving a portion of a deformable sheet and a second configuration wherein the first and second members are capable of gripping a deformable sheet; and, a source of suction located in the recess, the source of suction positioned to draw a portion of a deformable sheet located in a vicinity of the recess into the recess and away from the object, wherein the first member comprises a first edge, the second member comprises a second edge and the recess is defined by a space between the first and second edges.

28. An apparatus according to claim 27, wherein at least one of the first and second edges is elongated.

29. An apparatus for separating a deformable sheet from a surface of a relatively rigid object, the apparatus comprising:

first and second members movable relative to one another between a first configuration wherein the first and second members form a recess capable of receiving a portion of a deformable sheet and a second configuration wherein the first and second members are capable of gripping a deformable sheet; and, a source of suction located in the recess, the source of suction positioned to draw a portion of a deformable sheet located in a vicinity of the recess into the recess and away from the object, wherein the portion of the deformable sheet comprises a bight of the deformable sheet.

30. An apparatus for separating a deformable sheet from a surface of a relatively rigid object, the apparatus comprising:

a first member having a first aperture therethrough;

a second member, which abuts the first member and has a second aperture therethrough;

a source of suction positioned to draw a portion of a deformable sheet away from an object and into a recess formed by the first and second apertures when they are at least partially aligned; and, a means for moving the first member and the second member relative to one another into a configuration wherein the portion on the deformable sheet in the recess is gripped between an edge of the first aperture and an edge of the second aperture.

31. An apparatus for separating a deformable sheet from a surface of a relatively rigid object, the apparatus comprising:

a first member, which comprises a first edge;

a second member, which comprises a second edge;

a source of suction, which is positioned to draw a portion of the deformable sheet away from the object and into a space between the first and second edges; and, a means for moving the first member and the second member relative to one another to close the space between the first and second edges and to grip the portion of the deformable sheet between the first and second edges.

* * * * *